US007293805B1

(12) United States Patent
Hsieh

(10) Patent No.: US 7,293,805 B1
(45) Date of Patent: Nov. 13, 2007

(54) SAFETY DOOR CENTRAL RELEASE DEVICE

(76) Inventor: Chung-Hsien Hsieh, 116 Fen Liao Road, Sec. 1, Lin-Kou Hsiang, Taipei Hsien (TW)

( * ) Notice: Subject to any disclaimer, the term of this patent is extended or adjusted under 35 U.S.C. 154(b) by 0 days.

(21) Appl. No.: 11/451,256

(22) Filed: Jun. 12, 2006

(51) Int. Cl.
*E05B 65/10* (2006.01)

(52) U.S. Cl. ..... 292/201; 292/92; 292/93; 292/DIG. 65; 49/1; 49/2; 49/5; 160/9

(58) Field of Classification Search .... 292/DIG. 65 X, 292/DIG. 66, 251.5, 92 X, 93, 270, 278, 292/DIG. 36, 201; 49/1 X, 2 X, 5 X; 160/1, 160/6, 9 X; 16/49
See application file for complete search history.

(56) References Cited

U.S. PATENT DOCUMENTS 621,574 A * 3/1899 Kinsey ..... 292/24
3,729,770 A * 5/1973 Lasier ..... 16/48.5
3,771,823 A * 11/1973 Schnarr ..... 292/270
3,955,840 A * 5/1976 Rawls et al. ..... 292/229
4,878,265 A * 11/1989 Nesbitt ..... 16/49
5,044,680 A * 9/1991 Baker et al. ..... 292/278
5,140,173 A * 8/1992 Chau et al. ..... 307/125
5,551,187 A * 9/1996 Brouwer et al. ..... 49/1
5,839,766 A * 11/1998 Iannuzzi et al. ..... 292/144
5,901,992 A * 5/1999 Winkler ..... 292/270
6,484,784 B1 * 11/2002 Weik et al. ..... 160/7

* cited by examiner

*Primary Examiner*—Brian E. Glessner
*Assistant Examiner*—Mark Williams
(74) *Attorney, Agent, or Firm*—Bucknam and Archer

(57) ABSTRACT

This invention relates to a type of safety door central release device which can be used to close the safety door automatically when electric power is disrupted. It comprises a cord that is tied to a mechanism having potential energy on one end, and extended to a far distance on the other end; a pair of crank arms of which one end molded as a grip and gripping the cord, and the other end is connected to a sliding bar, having potential energy which assists the grip in release the cord. When electric power is supplied, the sliding bar will be attracted to an electromagnet. As a result, while electric power is disrupted, the release device can immediately release the cord. Due to release of the cord, a brake for a door operator is released by means of the mechanism such that the safety door slides down and then it is closed.

14 Claims, 5 Drawing Sheets

SAFETY DOOR CENTRAL RELEASE DEVICE

TECHNICAL FIELD

The invention relates to a type of central release device for a safety door, which can be automatically closed when power supply is disrupted.

BACKGROUND OF THE INVENTION

The traditional safety door is used either as a fire door or emergency escape exit. Two types of systems are usually used with the safety door. One is a failsafe system and the other is a non-failsafe system.

(1) The failsafe system: When the power supply is disrupted, regardless of whatever reason, the brake for the door operator is released immediately and the safety door is closed. If electric power is not disrupted in a fire, the smoke detector, the power supply will be cut off by means of a smoke detector, temperature sensor or fire detector. In other cases, devices with fusible links is molten under high temperatures and mechanically cut off the power supply to release the brake, and cause the fire door to slide down under its dead weight and close the safety door. These models are effective if power is disrupted due to fire hazards, and can stop the flames and smoke from spreading, making them highly effective in fire safety. But, if the disruption of power is not due to fire, this system will be inconvenient for the users and prevent them from using the safety door under normal circumstances.

(2) The non-failsafe system: When power supply is disrupted, regardless of the reasons, the brake is still in a braking state and the safety door is not closed immediately. When a fire is detected by means of a smoke detector, temperature sensor or fire detector, a standby power of a capacitor or battery is supplied to the brake for releasing the braking state. Alternatively, devices with fusible links is melt under high temperatures, and mechanically release the brake such that the fire door slides down under its dead weight and then is closed. These models will not close the safety door immediately when electric power is disrupted. The primary advantage of this system is that if an event of power failure is not caused by a fire, it will not be inconvenient for the users and not prevent them from using the safety door under normal circumstances.

As shown in FIG. 1A, the conventional device with fusible links comprises a cord (a) connected with fusible links in series. One end of the cord (a) has potential energy, and the other end of the cord (a) is attached to a retaining device (c) which is connected to an actuating rod of a electromagnet (d). The cord (a) is stretched tight by the retaining device (c). When a fire is detected by means of the smoke detector, temperature sensor or fire detector, a standby power of a capacitor or battery is supplied to the electromagnet (d), and the electromagnet (d) actuates the retaining device (c) to release the potential energy of the cord (a). Alternatively, the fusible links on the cord (a) are molten and broken under high temperatures, and the potential energy of the cord (a) is released due to breakage of the fusible links.

Deficiencies of the failsafe type and the non-failsafe type may be improved with fusible links. However, for a person skilled in the art, it should be understood that a standby power is necessary for the device to release the potential energy. The case of the electromagnet failure, the case that the standby power is broken before a fire is detected and the case that a fire breaks out a distance away from fusible links, in anyone of them, the safety door cannot be closed. There is still room for improvement.

SUMMARY OF INVENTION

As the non-failsafe model is not effective in fire safety, this new invention provides a central release device for a safety door and modifies the non-failsafe into a failsafe model. The safety door can be closed automatically when power is disrupted so as to provide a higher level of fire safety.

For the purposes mentioned above and other objects, this central release device includes a cord, of which one end is an active end having potential energy, and the other end is a passive end; an outer casing defining an internal space in which a base plate is attached to one side of the casing and an electromagnet is attached on an opposite side, wherein the electromagnetic is switched on under ordinary circumstances; a pair of crank arms pivoted on the base plate of which one end forms a grip and the other end is connected to a linkage bar; a sliding bar wedged between the electromagnet and the linkage bar of which one end is attached to the linkage bar; and an intermediate piece. The sliding bar is joined to a spring with spring potential energy, and once this spring potential energy is released, the crank arms with the grip will be released. The other side of the sliding bar is attached with a retracted plate, which will be retracted to the electromagnet when the electromagnet is switch on. It will also cause the grip to be in a clamped position. One end of the intermediate piece is secured to the grip and the other end is tied to the passive end of the cord. When power is disrupted, the safety door will be closed immediately. And if the power is disrupted due to a fire, the fire door will be able to stop the smoke and flames from spreading to other places.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

This invention allows the safety door to close vertically or horizontally, and can be used as a fire door or an emergency escape exit, especially for the non-failsafe models. A brake-releasing bar or a braking device for a door operator is usually provided with an actuating device which actuate the brake-releasing bar or the braking device with a mechanical force in order to release the brake of the door operator when a fire occurs, and then the safety door slides down and closes due to its weight. As this invention does not involve improving on certain technologies, hence we will not delve into these technologies. This invention will be explained in reference to embodiments. It should be understood that the embodiments are described for illustrative purposes but not for limiting the scope of the invention. The invention will be best understood from the following description of specific embodiments when read in connection with the accompanying drawings.

Figure 1B:
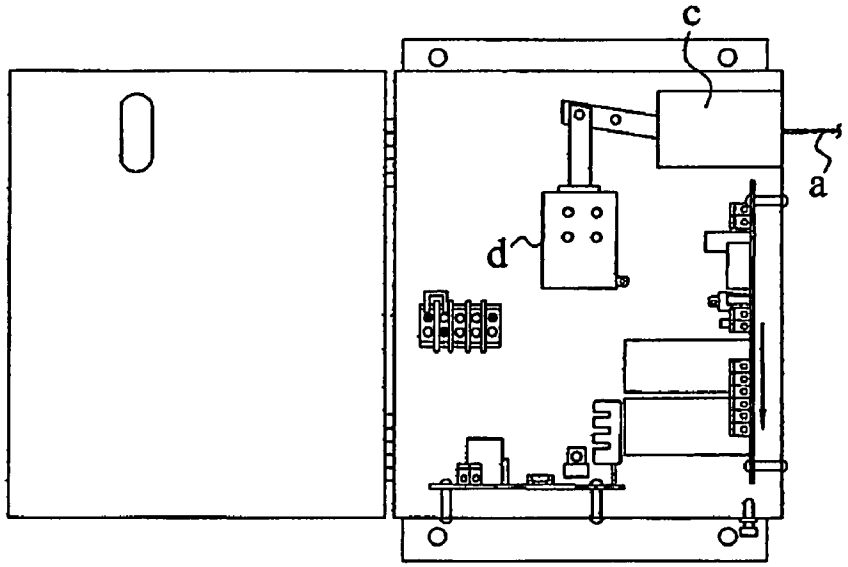
(PRIOR ART) FIG. 1B
FIG. 1B is the schematic diagram of the open/close switch.
Figure 1A:
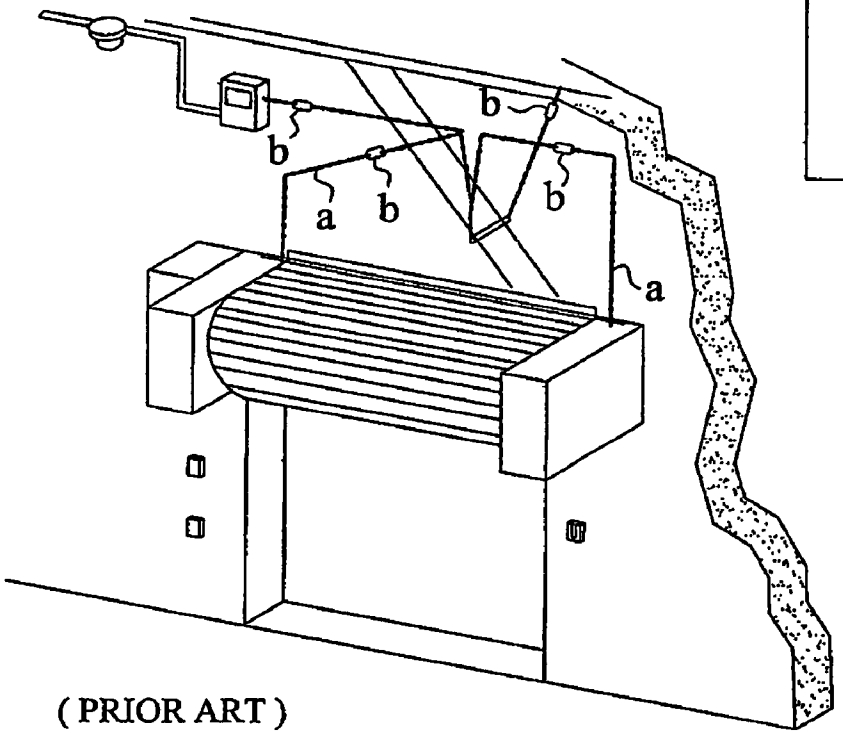
(PRIOR ART) FIG. 1A
FIG. 1A is the schematic diagram of the open/close switch of the central release device on the safety door.
Figure 2:
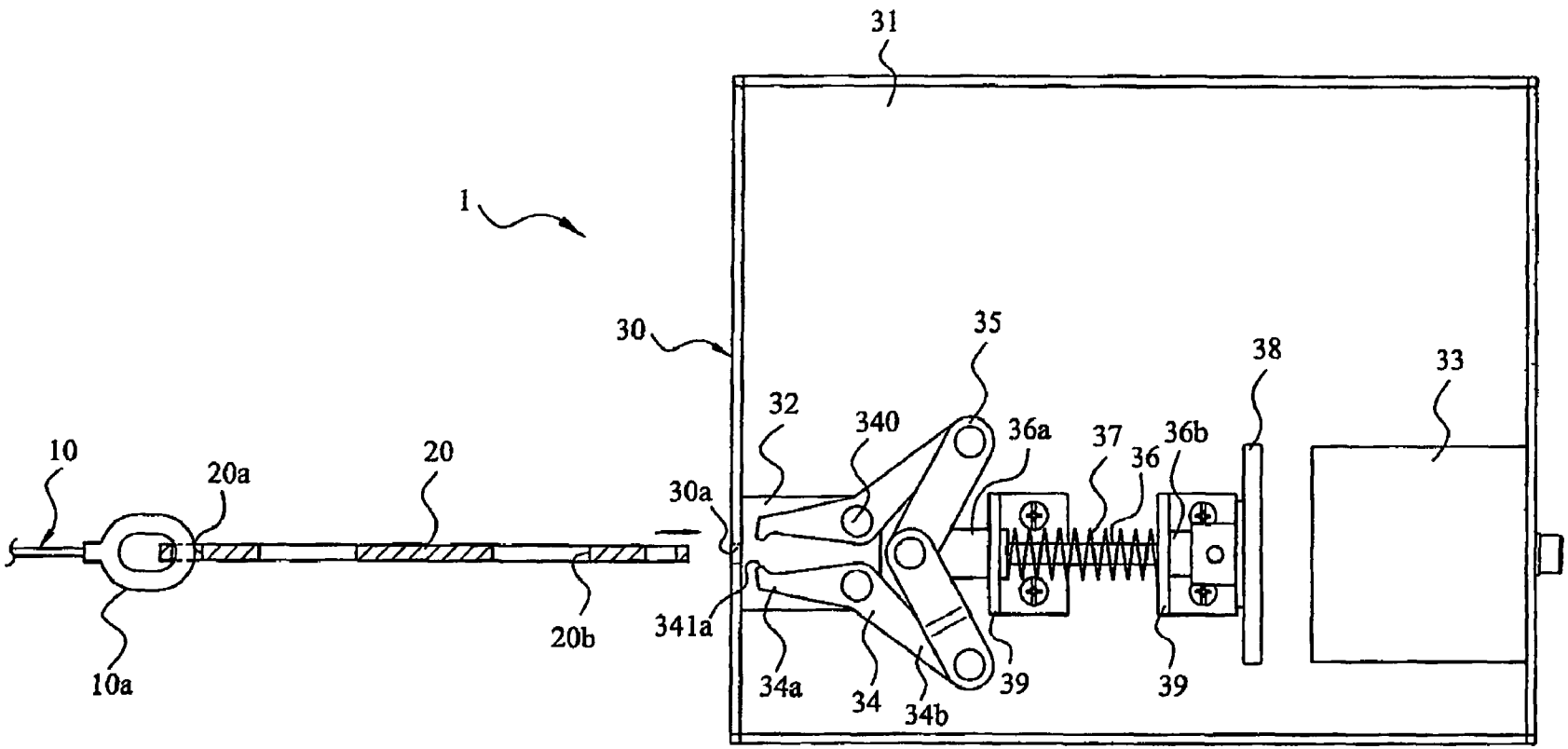
FIG. 2 is the schematic diagram of the first embodiment of the central release device of the present invention in a free state.
Figure 3:
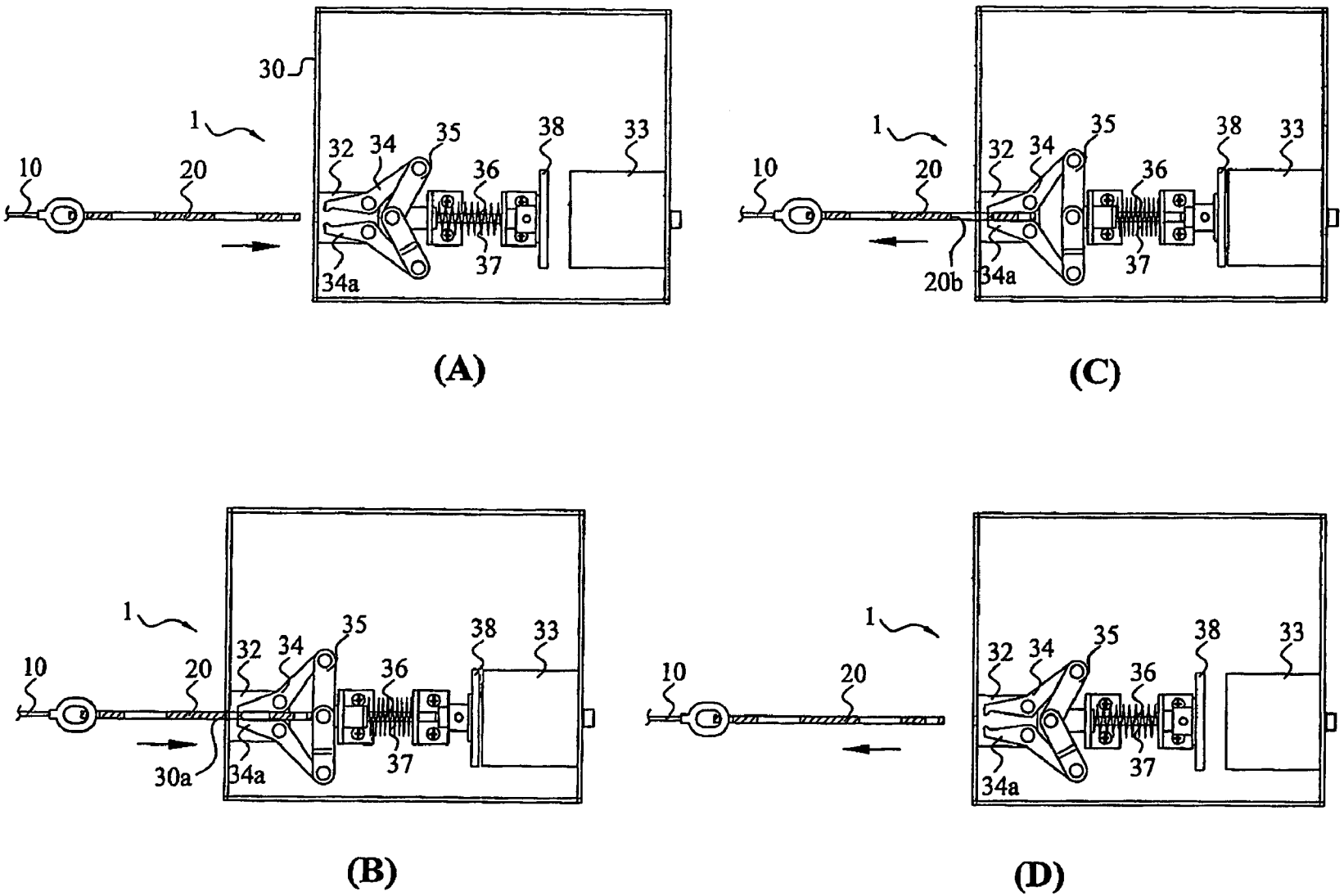
FIG. 3 is the schematic diagram of the operational state of the first embodiment shown in FIG. 2: (A) shows a setting process; (B) shows that the setting process is finished; (C) shows a held state; (D) shows a releasing process.

FIGS. 2 and 3 show the first embodiments of the central release device 1. The device (1) comprises a cord (10) of which one end is passive end (10*a*) and the other end is an active end, for example the active end is connected with the brake-releasing bar (not shown) or the braking device on the shaft of the door operator (not shown), the active end having potential energy; an outer casing (30) defining an internal space (31) in which a base plate (32) is attached to one side of the casing (30) and an electromagnet (33) is attached on an opposite side, the electromagnet (33) being switched on in normal circumstance; a pair of crank arms (34) pivoted on the base plate (32) at the middle of the crank arms with a pin (340) of which one end forms a grip (34*a*) and the other end (34*b*) is connected with a linkage bar (35); a sliding bar (36) wedged between the electromagnet (33) and the linkage bar (35) of which one end (36*a*) is attached to the linkage bar (35), both ends of the sliding bar (36) being guided by a pair of guiding plates (39). A spring (37) through which the sliding bar (36) passes is sandwiched between the two guiding plates (39), and causes the sliding bar (36) to contain potential energy actuating the linkage bar (35) and enabling the grip (34*a*) of the crank arms (34) to incline to a release position. One end (36*b*) of the sliding bar (36) is attached to a retracted plate (38) and when the electromagnet (33) is switch on, the sliding bar will be retracted on the electromagnet (33) and causes the grip (34*a*) of the crank arms (34) to remain in clamp position. Both ends of a intermediate piece (20) have a aperture (20*a*, 20*b*) respectively, and the aperture (20*a*) is attached to the passive end (10*a*) of the cord (10) passive part (10*a*). The aperture (20*b*) is clamped by the grip (34*a*) of the crank arms (34). The grip (34*a*) of the crank arms (34) is provided with a fastening (341*a*) that is secured to the aperture (20*b*).

The aforesaid central release device (1) operational process is shown in FIG. 3. FIG. 3(A) shows a setting process; FIG. 3(B) illustrates that the setting process is finished; FIG. 3(C) shows a held state; and FIG. 3(D) shows a releasing process. According to this invention the electromagnet (33) is switched on in normal circumstances. Due to the spring (37) having spring force resisting the retracting force from the electromagnetic (33), the device (1) is in a free state (as shown in FIG. 3A) prior to the setting process. In the setting process, the free end of piece (20) is inserted through a guide slot (30*a*) of the casing (30), and this free end pushes the linkage bar (35) and the sliding bar (36) towards the electromagnet (33) (as shown in FIG. 3B). This will cause the sliding bar (36) to be moved against the spring (37) potential energy and makes the retracted plate (38) to be retracted on the electromagnet (33) while the grip (34*a*) of the crank arms (34) clamps the aperture (20*b*) of the intermediate piece (20) through action of the linkage bar (35) (as shown in FIG. 3C). On the other hand, in a event of power failure, no matter what causes the event, the sliding bar (36) is released, and the spring (37) pushed the linkage bar (35) and causes the grip (34*a*) of the crank arms (34) to release the intermediate piece 20 (as shown in FIG. 3D), and the brake of the door operator is released due to release of the cord (10).

Figure 4:
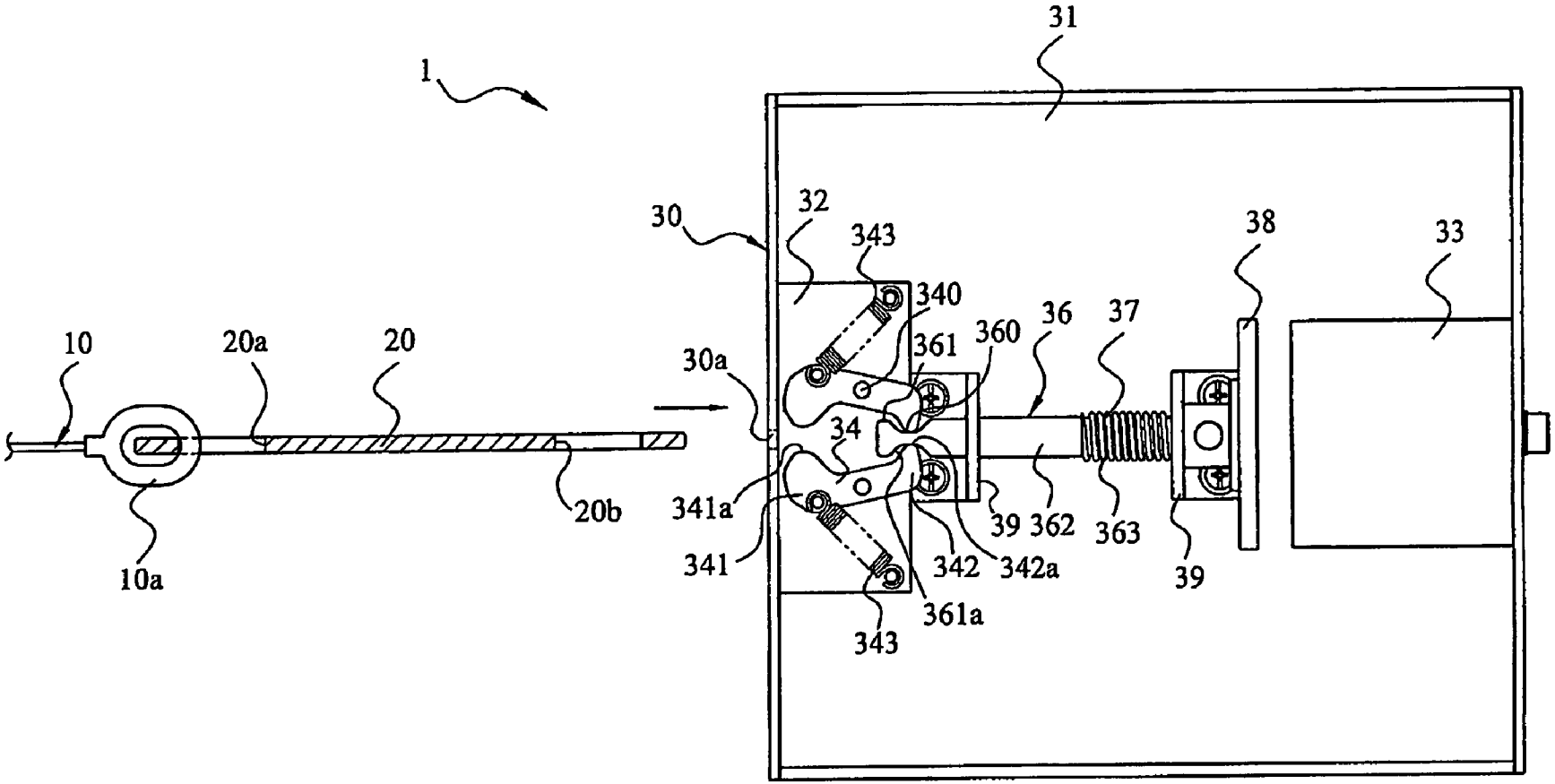
FIG. 4 is the second embodiment of the central release device of the present invention in a free state.
Figure 5:
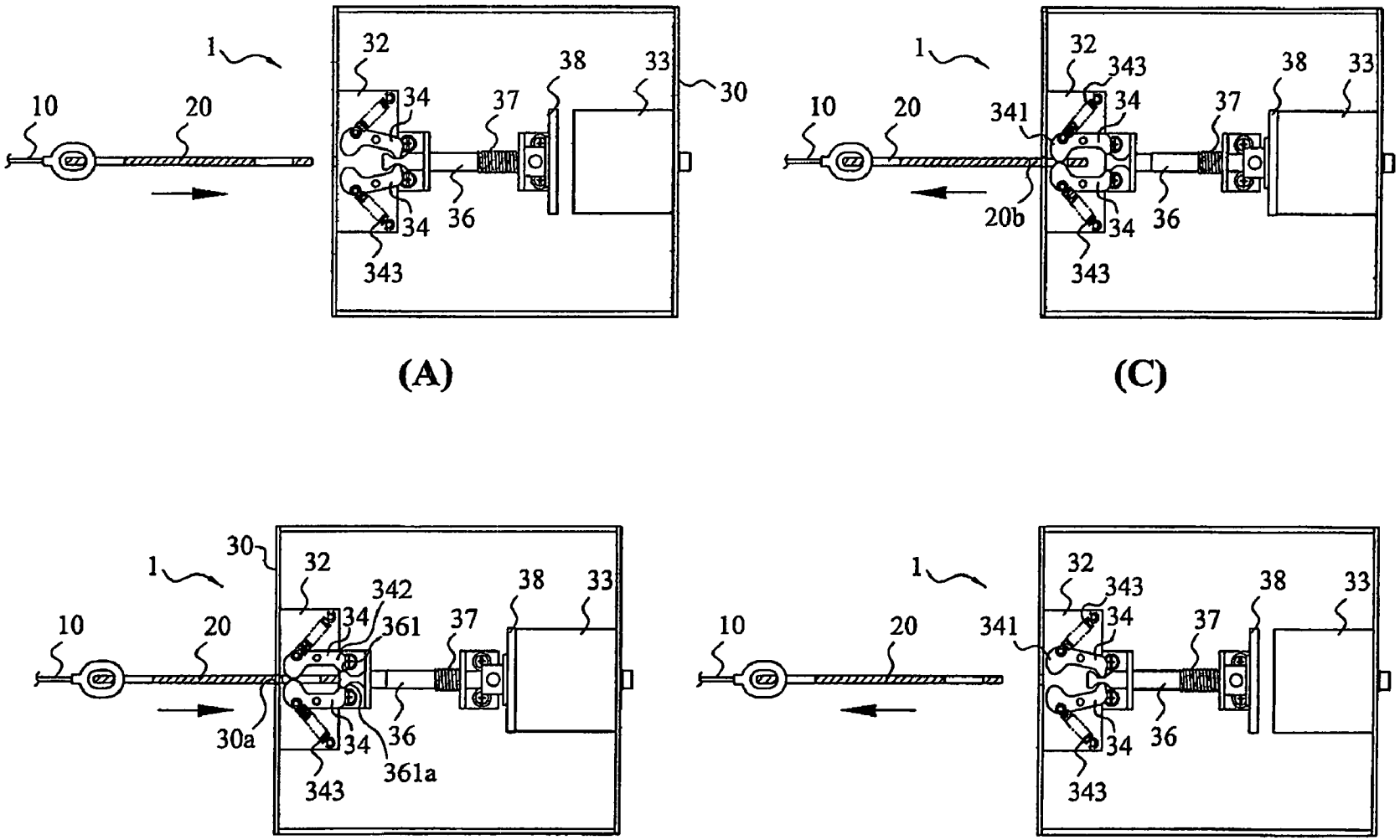
FIG. 5 is the schematic diagram of the operational state of the second embodiment shown in FIG. 4: (A) shows a setting process; (B) shows that the setting process is finished; (C) shows a held state; (D) shows a releasing process.

FIGS. 4 and 5 illustrate the second embodiment of the central release device (1) for a safety door. The components include: a cord (10) of which one end is a passive end (10*a*) and the other end is an active end, for example the active end is connected with the brake-releasing bar (not shown) or the braking device on the shaft of the door operator (not shown), the active end having potential energy; a outer casing (30) defining an internal space (31) in which a base plate (32) is attached to one side of the casing (30) and an electromagnet (33) is attached on an opposite side, the electromagnet (33) being switched on in normal circumstances; a pair of crank arms (34) pivoted on the base plate (32) at the middle of the crank arms with a pin (340), both ends of the crank arms (34) forming a first grip (341) and a second grip (342) respectively, the first grip (341) being formed with a fastening (341*a*) protruding from inside; a pair of springs (343) of which one end is attached to the fastening (341*a*) of the crank arms (34) and the other end is moved 45 degrees from the crank arms (45) and anchored on the base plate (32) such that due to potential energy of the spring (343) the second grip (342) remains in a clamped position, the second grip (342) being formed with a fastening (342*a*) protruding from inside; and a sliding bar (36) arranged between the electromagnet (33) and the crank arms (34) and guided by a guiding plate. One end of the sliding forms a clamped portion (360) and a protruding rim (361) which is on an exterior of the clamped portion (360). A guiding part (361*a*) is formed between the clamped portion (360) and the protruding rim (361). The middle of the sliding bar (36) includes a square shaft (362) and a circular shaft (363). A spring (37) passes through which the circular shaft (363) of the sliding bar (36) passes is placed between the square shaft (362) and the base plate (39). Due to potential energy of the spring (37), the clamped portion (360) of the sliding bar (36) is clamped by the second grip (342) of the crank arms. The other end of the sliding bar (36) is provided with a retracted plate (38). The plate (38) can be retracted by the electromagnet (33) being switched on while the protruding rim (361) pushes the second grip (342) of the crank arms (34) through displacement of the sliding bar (36) and thus making the first grip (341) remain in a clamp position. Both ends of an intermediate piece (20) have an apertures (20*a*, 20*b*) respectively. The aperture (20*a*) is tied to the passive end (10*a*) of the cord (10) while the aperture (20*b*) is secured to the fastening (341*a*) of the first grip (341) of the crank arms (34).

In the central release device (1) mentioned above, the operational process is shown in FIG. 5, and FIG. 5(A) shows a setting process; FIG. 5(B) illustrates that the setting process is finished; FIG. 5(C) shows a held state; and FIG. 5(D) shows a releasing process. According to the present invention, the electromagnet (33) is switched on in normal circumstances. Due to the spring (37) having a spring force resisting the retracted force from the electromagnet (33), the device (1) is in a free state (as shown in FIG. 5(A)) prior to the setting process. In the setting process, the free end of the intermediate piece (20) is inserted through a guide slot (30*a*) of the casing (30), and this free end pushes the sliding bar (36) toward the electromagnet (33) (as shown in FIG. 5(B)). This causes the sliding bar (36) to be moved against potential energy of the spring (37) and makes the retracted plate (38) to be retracted on the electromagnet (33). While the sliding bar (36) is moved, the protruding rim (361) pushes open the second grip (342) of the crank arms (34) by the guiding part (361*a*). This allows the first grip (341) to resist potential energy of the spring (343), and fasten itself to the aperture (20*b*) of the intermediate piece (20) (as shown in FIG. 5C). In an event of power failure, no matter what causes the event, the sliding bar (36) is released and moved back to its original position by the spring (37). The crank arms (34) is also affected by the spring (343) and causes the first grip (341) to release the intermediate piece (20) (as shown in FIG. 5D), and the brake for the door operator is releases due to release of the cord (10).

As mentioned above, the central release device is simple in design and can easily modify a non-failsafe safety door into a failsafe. The safety door can be automatically closed and makes it safer against fire hazards, hence this device is a new, progressive and useful invention.

While this invention has been described in reference to preferred embodiments, the invention is not limited to the embodiments. It should be understood that numerous charges and variations may be made without departing from the spirit or scope of the following claims.

LIST OF REFERENCE NUMERALS

| | |
|---|---|
| 1 | Central Release Device |
| 10 | Cord |
| 10a | Passive End |
| 20 | Intermediate Piece |
| 30 | Outer Casing |
| 30a | Guide Part |
| 31 | Internal Space |
| 32 | Base plate |
| 33 | Electromagnet |
| 34 | Crank Arms |
| 34a | Grip |
| 340 | Pin |
| 341 | First Grip |
| 341a | Fastening |
| 342 | Second Grip |
| 342a | Fastening |
| 343 | Spring |
| 35 | Linkage Bar |
| 36 | Sliding Bar |
| 360 | Clamped Portion |
| 361 | Protruding Rim |
| 361a | Guiding Part |
| 362 | Square shaft |
| 363 | Circular shaft |
| 37 | Spring |
| 38 | Retracted plate |
| 39 | Guiding Plate |

I claim:

1. A central release device (1) for a safety door which can be used to close the door automatically when power is disrupted, comprising:

a cord (10), of which one end is a passive end (10*a*) and the other end is an active end having potential energy;

a outer casing (30) defining an internal space (31), in which a base plate (32) is attached to one side of the casing (30) and an electromagnet (33) is attached on an opposite side, the electromagnet (33) being switched on in normal circumstances;

a pair of crank arms (34) pivoted on the base plate (32) of which one end of each arm forms a grip (34*a*) and the other end of each arm (34*b*) is connected to a linkage bar (35);

a sliding bar (36) wedged between the electromagnet (33) and the linkage bar (35) of which one end of the sliding bar (36*a*) is connected to the linkage bar (35), and the sliding bar (36) being provided with a spring (37) enabling the grip (34*a*) of arms (34) to incline to a release position, and the other end (36*b*) of the sliding bar (36) being connected to a retracted plate (38), retracted on the electromagnet (33) when the electromagnet (33) is switched on such that the grip (34*a*) of the crank arms (34) remains in a clamped position; and an intermediate piece (20) of which one end is tied to the passive end (10*a*) of the cord (10) and the other end is clamped onto the grip (34*a*) of the crank arms (34).

2. The central release device as claimed in claim 1, wherein the sliding bar (36) is guided by a pair of guiding plates (39).

3. The central release device as claimed in claim 2, wherein the spring (37) through which the sliding bar (36) passes is sandwiched between the two guiding plates (39).

4. The central release device as claimed in claim 3, wherein two apertures (20*a*, 20*b*) is formed at two ends of the intermediate piece (20) respectively, the aperture (20*a*) being tied to the passive end (10*a*) of the cord (10), and the aperture (206) being clamped by a protruding fastening (341*a*) formed on the grip (34*a*) of the crank arms (34).

5. The central release device as claimed in claim 4, wherein the safety door serves as fire door or an emergency escape exit.

6. A central release device (1) for a safety door which can be used to close the safety door automatically when power is disrupted, the device (1) comprising:

a cord (10) of which one end is a passive end (10*a*) and the other end is an active end having potential energy;

a outer casing (30) defining an internal space (31) in which a base plate (32) is attached to one side of the casing (30) and an electromagnet (33) is attached on the opposite side, the electromagnet (33) being switched on in normal circumstance;

a pair of crank arms (34) pivoted on the base plate (32) of which both ends of each arm form a first grip (341) and a second grip (342) respectively, each of the crank arms (34) having a spring (343) that contains potential energy and can make the second grip (342) to form a clamped position;

a sliding bar (36) wedged between the electromagnet (33) and the pair of crank arms (34) of which one end of the sliding bar is provided with a clamped portion (360) and a protruding rim (361), the sliding bar (36) having a spring (37) with potential energy that can cause the clamped portion (360) to be clamped by the second grip (342) of the crank arms (34), the other side of the sliding bar (36) being connected to a retracted plate (38), which will be retracted to the electromagnet (33) when the electromagnet is switched on, and the second grip (342) of the crank arms (34) is pushes by the protruding rim (361) simultaneously such that the first grip (341) will correspondingly form a clamped position;

a intermediate piece (20), of which one end is tied to the passive end (10*a*) of the cord (10) and the other end is clamped by the first grip (341) of the crank arms (34).

7. The central release device as claimed in claim 6, wherein both ends of the sliding bar (36) are guided to slide by a pair of guiding plates (39).

8. The central release device as claimed in claim 7, wherein the sliding bar (36) contains a square shaft (362) and a circular shaft (363).

9. The central release device as claimed in claim 8, wherein the spring (37) through which the circular shaft (363) of the sliding bar (36) passes is sandwiched between the square shaft (362) and one of the guiding plate (39).

10. The central release device as claimed in claim 9, wherein the protruding rim (361) of the sliding bar (36) is on an exterior of the clamped portion (360), a guiding part (361*a*) being formed between the protruding rim (361) and the claimed portion (360).

11. The door central release device as claimed in claim 10, wherein the second grip (342) of the crank arms (34) forms a protruding fastening (342*a*) that clamps the clamped portion (360).

12. The central release device as claimed in claim 11, wherein two sides of the intermediate coil (20) has two apertures (20*a*, 20*b*) and one aperture (20*a*) is tied to the cord (10) passive part (10*a*), and the first grip (341) of the crank arms (34) forms a protruding fastening (341*a*) for clamping the other aperture (20*b*).

13. The door central release device as claimed in claim 12, wherein one side of the spring (343) is mounted to the fastening (341*a*) of the crank arms (34), and the other side is attached to the crank arms (34) and is mounted at 45 degrees on the base plate (32).

14. The door central release device as claimed in claim 12, wherein the safety door serves as a fire door or an emergency escape exit.

* * * * *